US005242463A

United States Patent [19]

Blanchard et al.

[11] Patent Number: 5,242,463

[45] Date of Patent: Sep. 7, 1993

[54] ANIONICALLY DYEABLE SMOOTH-DRY CROSSLINKED CELLULOSIC MATERIAL CREATED BY TREATMENT OF CELLULOSE WITH NON-REACTIVE GLYCOL ETHER SWELLING AGENTS AND NITROGEN BASED COMPOUNDS

[75] Inventors: Eugene J. Blanchard, Metairie; Robert M. Reinhardt, New Orleans, both of La.

[73] Assignee: The United States of America as represented by the Secretary of Agriculture, Washington, D.C.

[21] Appl. No.: 665,044

[22] Filed: Mar. 6, 1991

[51] Int. Cl.[5] ..... D06M 1/22; D06M 13/16; D06M 13/34

[52] U.S. Cl. ..... 8/196; 8/116.1; 8/188; 8/189; 8/190; 8/680; 8/918; 8/930

[58] Field of Search ..... 8/181, 188, 196, 189, 8/190, 130, 680, 116.4, 585

[56] References Cited

U.S. PATENT DOCUMENTS 3,788,804 1/1974 Harper, Jr. et al. ..... 8/181
3,807,946 4/1974 Harper, Jr. et al. ..... 8/181
3,853,459 12/1974 Harper, Jr. et al. ..... 8/181
4,780,102 10/1988 Harper, Jr. ..... 8/196

OTHER PUBLICATIONS

Pierce, et al., *Textile Research Journal*, vol. 34 (1964), pp. 552–558.

Tovey, et al. *Textile Research Journal*, vol. 36, pp. 853–855 (1966).

*Primary Examiner*—Prince Willis, Jr.
*Assistant Examiner*—John F. McNally
*Attorney, Agent, or Firm*—M. Howard Silverstein; John D. Fado; Joseph A. Lipovsky

[57] ABSTRACT

Anionically dyeable smooth-dry crosslinked cellulose is produced by modifying cellulose-containing material with the combination of a hydroxyalkylamine or a hydroxyalkyl quaternary ammonium salt, a methylolamide crosslinking agent and one or more reactively inert glycol ether swelling agents. The reaction is typically catalyzed with salts such as zinc nitrate or magnesium chloride used either alone or in conjunction with citric acid. Types of usable anionic dyes include acid, direct, and reactive dyes. The cellulose-containing material may be in the form of fibers, threads, linters, roving, fabrics, yarns, slivers and paper.

41 Claims, No Drawings

ANIONICALLY DYEABLE SMOOTH-DRY CROSSLINKED CELLULOSIC MATERIAL CREATED BY TREATMENT OF CELLULOSE WITH NON-REACTIVE GLYCOL ETHER SWELLING AGENTS AND NITROGEN BASED COMPOUNDS

BACKGROUND OF THE INVENTION

1. Field of the Invention

This invention relates to dyeable cellulosic material and its creation by means of crosslinking a cellulosic material with a methylolamide crosslinking agent which is further modified by one or more salts of a hydroxyalkylamine or a hydroxyalkyl quaternary ammonium compound and one or more reactively inert glycol ether swelling agents.

2. Description of the Prior Art

Cellulosic fabrics do not possess smooth-dry (durable press or wash wear) performance or dimensional stability. In order to acquire these properties, cellulosic fabric requires a chemical finish. The chemical agents used in these processes are known as crosslinking agents. Examples of some agents are dimethylol dihydroxyethyleneurea (DMDHEU) or dimethylol propylcarbamate (DMPC).

While treatment of cellulosic fabric with a crosslinking agent does make the fabric smooth drying and dimensionally stable, it reduces the dyeability of cellulose by causing the cellulosic fibers to become fixed in a collapsed state upon their being cured at elevated temperature. Therefore, modern textile processes require fabric to be dyed first and then finished for smooth dry performance. When fabrics are crosslinked with common and readily available agents, such as DMDHEU or DMPC, subsequent dyeing has been unsuccessful.

Previously, crosslinking agents and reactive additives have been utilized as a route to dyeable crosslinked fabrics. U.S. Pat. No. 3,788,804 teaches the use of crosslinking agents and hydroxycarboxylic acids to form crosslinked fabrics with acidic grafts, and dyeing the fabrics with basic dyes. Also, U.S. Pat. No. 3,807,946 teaches the use of crosslinking agents and a reactive additive such as triethanolamine to form a crosslinked fabric with a grafted amine and dyeing such with an acid dye. U.S. Pat. No. 3,853,459 utilizes a treatment of crosslinking agent and polymer to form a durable-press fabric with a polymeric treatment and dyeing with a disperse dyestuff.

These patents have in common the teaching of dyeing modified cellulosic fabrics with non-cellulosic dyestuffs. Consequently, the performance of these dyes on a cellulosic substrate is not as good as cellulose dyed with normal dyestuffs such as direct or reactive dyes which are usually used on cellulosic fabrics.

Pierce et al. [Tex. Res. J. 34: 552–558 (1964)] have shown that glycol ethers are capable of propping open the cellulosic fiber so that crosslinking occurs in a swollen state. Tovey et al. [Tex. Res. J. 36: 853 (1966)] have reported the use of high-boiling chemical agents to alter properties of crosslinked cotton fabric. However, there are no reports in the literature on the use of nonreactive glycol ethers in conjunction with nitrogenous additives for the purpose of improving the dyeing characteristics of crosslinked cellulosic materials with medium-and high-molecular-weight anionic dyes.

U.S. Pat. No. 4,780,102 teaches improved dyeing properties for cotton finished with both a crosslinking agent and polyethylene glycol. Fabric treated according to this method can be dyed with dyes normally used with untreated cotton, such as direct and reactive dyes, but color strength is adversely affected with the increasing molecular weight of the dye. Usually, the color strength of the finished-crosslinked material is not as good as that of the untreated cotton. Also, such fabric cannot be dyed with acid dyes nor with reactive dyes under acidic conditions.

SUMMARY OF THE INVENTION

This invention describes the production of crosslinked cellulosic materials that have smooth drying properties as well as enhanced affinity for anionic dyestuffs. The method involves treating cellulosic material with a methylolamide crosslinking agent, a catalyst, one or more of a hydroxyalkylamine or a hydroxyalkyl quaternary ammonium compound, and one or more reactively inert glycol ether swelling agents, followed by drying and curing to react the components with the cellulosic material. The cured material can be optionally washed to remove any inert, unreacted glycol ether prior to being dyed with anionic dyestuffs to produce colored, wrinkle-resistant cellulosic material.

Therefore, it is an object of this invention to produce cellulosic materials which are readily dyeable with anionic dyes under acidic conditions, which cellulosic materials previously have been crosslinked with a methylolamide crosslinking agent in the presence of one or more of a hydroxyalkylamine or a hydroxyalkyl quaternary ammonium compound and one or more reactively inert glycol ether swelling agents.

Another object of the invention is to perform the dyeing step under neutral to acidic conditions, thereby eliminating the need for other bases, added salts such as carbonates, and salts conventionally used in cellulosic fabric dyeing procedures Another object of the invention is to enable the dyeing of crosslinked cellulosic materials with high molecular-weight anionic dyes.

Still another object of the invention is to provide a wide variety of multicolored effects by combining treated and untreated cellulosic yarns in cotton fabrics.

Other objects and advantages of the invention will become readily apparent from the ensuing description.

Detailed Description of the Invention

The present invention is based upon the discovery that the dyeability of smooth-dry crosslinked cellulose with regard to anionic dyestuffs is markedly enhanced over that previously achieved in the prior art. This is accomplished by incorporating one or more of a salt of hydroxyalkylamine compound or a hydroxyalkyl quaternary ammonium salt and one or more reactively inert glycol ether swelling agents into the matrix of a cellulose substrate by means of a methylolamide crosslinking agent which in and of itself gives cellulose durable press properties.

The underlying theory behind the instant invention is that the incorporation of both 1) a reactive hydroxyalkylamine or a hydroxyalkyl quaternary ammonium compound and 2) a reactively inert glycol ether swelling agent, into the structure of a methylolamide crosslinked cellulose respectively alters the charge of the structure and swells the cellulose during the crosslinking process so that a more open structure, which allows larger dye molecules to interact with the cellulose, is produced.

This structure, altered in terms of both charge and density, is amenable to dyeing with agents including anionic dyestuffs. The most marked improvement over the prior art is noted with anionic dyes having molecular weights from about 750 to about 1500. These dyes are already conventional in the textile industry as dyestuffs for non-crosslinked cellulose.

The process to produce the crosslinked cellulosic product of the instant invention may be accomplished by treating the cellulosic material with an aqueous formulation comprising a methylolamide crosslinking agent, a catalyst, one or more of a hydroxyalkylamine salt or a hydroxyalkyl quaternary ammonium salt and one or more reactively inert glycol ether swelling agents, with subsequent drying and curing.

The present invention is applicable to fibrous cellulosic material including cotton, flax, jute, hemp, ramie and regenerated unsubstituted wood celluloses such as rayon. Combinations of said cellulosics and combinations of said cellulosics with other fibers such as polyesters, nylons, acrylics, and the like also can be treated. The disclosed process may be applied to fibrous cellulosic material in the form of woven and non-woven textiles such as yarns and woven or knit fabrics, and to fibers, threads, linters, roving, slivers or paper. The disclosed process is most advantageous with material containing about 50%-100% cellulose. The preferred material is cotton.

A wide variety of compounds may be used as the methylolamide crosslinking agent of the invention. Useful compounds include methylolated ureas, cyclic ureas, urons, triazones, carbamates, and triazines, as well as alkylated and hydroxyalkylated derivatives thereof. A non-limitative list of typical agents includes dimethylol urea, partially methylolated urea, methylated urea-formaldehyde, dimethylol ethyleneurea, dimethylol dihydroxyethyleneurea, dimethylol propyleneurea, dimethylol substituted propyleneurea, tri- and tetramethylol acetyleneurea, bis(methoxymethyl)uron, dimethylol methyl carbamate, dimethylol propyl carbamate, methylolated melamines, methyoxymethylolated melamines, and the like. The especially preferred crosslinking agent is dimethylol dihydroxyethyleneurea (DMDHEU). The amount of crosslinking agent used is from about 3% to about 15% by weight of the formulation, with the preferred amount ranging from about 4% to about 8%. Should too little crosslinking agent be used, a product possessing the enhanced dyeing properties of the instant invention will not be acquired.

A reaction catalyst, which aids in the crosslinking of the cellulosic substrate with the methylolamide compound is present in the formulation in the amount of about 10% to about 60% based on the weight of the methylolamide crosslinking agent. Catalysts which can be used include: various mineral acids; organic acids; salts of strong acids, ammonium salts, alkanolamine salts, metallic salts; and combinations of the above. Useable compounds of such catalyst classes include but are not limited to the following:

a. Mineral acids such as hydrochloric acid, sulfuric acid, nitric acid, phosphoric acid and boric acid.
b. Organic acids such as oxalic acid, tartaric acid, citric acid, malic acid, glycolic acid, methoxyacetic acid, cloroacetic acid, lactic acid, 3-hydroxybutyric acid, methanesulfonic acid, ethanesulfonic acid, hydroxymethanesulfonic acid, benzenesulfonic acid, p-toluenesulfonic acid, cyclopentanetetracarboxylic acid, butanetetracarboxylic acid, tetrahydrofurantetracarboxylic acid, nitrilotriacetic acid, and ethylenediaminetetraacetic acid.
c. Salts of strong acids such as sodium bisulfate, sodium dihydrogen phosphate and disodium hydrogen phosphate.
d. Ammonium salts such as ammonium chloride, ammonium nitrate, ammonium sulfate, ammonium bisulfate, ammonium dihydrogen phosphate and diammonium hydrogen phosphate.
e. Alkanolamine salts such as the hydrochloride, nitrate, sulfate, phosphate and sulfamate salts of 2-amino-2-methyl-1-propanol, tris (hydroxymethyl-)aminomethane and 2-amino-2-ethyl-1-3-propanediol.
f. Metal salts such as aluminum chlorhydroxide, aluminum chloride, aluminum nitrate, aluminum sulfate, magnesium chloride, magnesium nitrate, magnesium sulfate, zinc chloride, zinc nitrate and zinc sulfate.

Preferred catalysts include the halide and nitrate salts of zinc or magnesium used either alone or in conjunction with citric acid. Preferred salts are zinc nitrate and magnesium chloride. A preferred mixed catalyst system is contempleted to contain a molar ratio of about 20:1 to about 5:1 of a metal salt to citric acid.

Non-reactive glycol ethers usable in conjunction with the instant invention include compounds of the general formula:

$$CH_3—O—(CH_2—CH_2—O)_x—CH_3$$

with a molecular weight ranging from about 134 to about 3000 (x being from about 2 to about 68). Preferred compounds include diethylene gylcol dimethyl ether (diglyme), triethylene glycol dimethyl ether (triglyme) and tetraethylene glycol dimethyl ether (tetraglyme). A factor used in determining which glycol ether to utilize will be the temperature used for the curing of the cellulosic material. The higher the molecular weight of the glycol ether, the higher its boiling point. The greater the difference between the curing temperature and the boiling point of the glycol ether, the less the probability of the ether being removed during the curing operation. The boiling point of diglyme is 162° C., which corresponds to the curing temperature used in the examples that follow. On the other hand, the boiling point of tetraglyme is 275° C., which is much higher than the usual curing temperature. The primary function of the glycol ether is to prevent the swollen cellulosic fiber from collapsing during the curing process at elevated temperatures. If the boiling point of the glycol ether is only moderately greater than the curing temperature, there is a greater possibility that the glycol ether might be removed from the substrate during the curing operation. As a consequence, the fibers might not be cured in their most swollen state, and maximum color strength with high molecular weight dyes might not be realized. The glycol ethers are used at concentrations ranging from about 5% to about 40% by weight of the formulation, with the preferred amount ranging from about 10% to about 20%.

The hydroxyalkylamine salt may be a primary, secondary or tertiary amine and may possess one, two, or three hydroxyalkyl groups. Usable compounds include halide salts of monoethanolamine, diethanolamine, triethanolamine, amino-2-ethyl-1,3-propandiol, 2-amino-2-methyl-1-propanol, 2-dimethylamino-2-methyl-1-propanol, N-methyldiethanolamine, and tris(hydroxymethyl)aminomethane. In a preferred embodiment the hydroxyalkylamine is used in its hydrochloride form. Preferred hydroxyalkylamines include hydroxyethylamine and triethanolamine. The most preferred hydroxyalkylamine is triethanolamine. This is due to its possession of the maximum number of hydroxyethyl groups, which is responsible for both its low amine odor and high level of activity with the crosslinking agent.

In an alternate embodiment the hydroxyalkylamines may be introduced into the formulation in their non-salt form but are then converted to their respective salts by reaction with the appropriate reagent prior to the addition of the catalyst.

The hydroxyalkyl quaternary ammonium salts envisioned for use in the reaction formulation include both the halide and sulfate salts of said compounds. Among the halide salts the chloride salt is preferred. Among the sulfate salts the dialkyl sulfate salts are preferred, with the dimethyl sulfate salts and diethyl sulfate salts being especially preferred. Examples of useable compounds include (2-hydroxyethyl)trimethylammonium chloride, bis(2-hydroxyethyl)dimethylammonium chloride, tris(2-hydroxyethyl)methylammonium chloride and tetrakis(2-hydroxyethyl)ammonium chloride.

The sum total amount of the hydroxyalkylamine salt and/or the hydroxyalkyl quaternary ammonium salt used in the formulation is from about 3% to about 15% by weight of the formulation.

The balance of the crosslinking formulation is represented by an aqueous solvent system which may be either water or a mixed system comprising either a water/alcohol mixture or a water/acetone mixture in a volumetric proportional ratio of about 99:01 to about 80:20. Useable alcohols include alkanols of 1 to 6 carbons, with ethanol being preferred. It should be noted that the reactively inert glycol ether component of the formulation is not defined in this invention as being a component of a mixed solvent system. The amount of solvent used is from about 10% to about 90% by weight of the formulation, with a preferred amount ranging from about 15% to about 75%.

The processes of the instant invention are carried out by first contacting the cellulosic material with the aqueous crosslinking formulation containing a methylolamide crosslinking agent, a catalyst, one or more of a hydroxyalkylamine salt or a hydroxyalkyl quaternary ammonium salt and one or more reactively inert glycol ether swelling agents. This may be done by spraying or immersion of the material in a bath of the crosslinking formulation. After being thoroughly wetted in the treating bath, the cellulosic material may be passed between squeeze rolls to remove excess liquid. Alternatively, low wet pickup techniques of application (sometimes called minimum add-on application) may be employed, such as by kiss roll, foam finishing, loop padding, spraying, printing, or other methods known in the art. The material is then dried at any convenient temperature just sufficient to remove the solvent within the desired amount of time. The material is then cured for about 15 seconds to about 5 minutes at an inversely corresponding temperature range of about 220° C. to about 100° C. Alternatively the above drying step can be omitted, and the material can be flash-cured to remove the solvent at the same time that the crosslinking of the cellulose takes place. If desired, the cured material may subsequently be given a water rinse to remove unutilized glycol ether swelling agents, and unreacted reagents and curing catalyst, and may then be redried. The fabrics may then be dyed after curing.

The fabrics can be dyed with acid, direct, and reactive classes of anionic dyes at a pH from about 2 to about 6, with the preferred pH being from about 3 to about 4.5. The dyebath pH can be adjusted to the proper level by adding a sufficient quantity of acetic acid or other suitable acid. Of the classes of dyes listed, unmodified cellulose has very little or no affinity for acid dyes under any pH conditions. Unmodified cellulose has affinity for reactive dyes only when the dyes are fixed to cellulose under alkaline pH conditions. When unmodified cellulose is dyed with these dyes, a salt such as sodium chloride or sodium sulfate must be added to the dyebath for proper exhaustion of dye into the fiber. In contrast, the modified material of the invention can be dyed effectively without utilizing any salt. However, if desired, from about 1% to about 2% of salt by weight of the dye solution can be used in the dyebath with any of acid, direct or reactive dyes.

The following examples are intended only to further illustrate the invention and are not intended to limit the scope of the invention which is defined by the claims, with all percentages herein disclosed being by weight unless otherwise specified.

Color strength was determined by means of a spectrophotometer and is expressed in terms of K/S values as calculated in the Kubelka-Munk equation. Procedures based on the Kubelka-Munk equation are used to measure dye absorption. This procedure utilizes a dilute dye solution to determine the wavelength of maximum dye absorption of a given dyestuff. Reflectance of the dyed fabric is measured at that wavelength. In the Kubelka-Munk equation $$K/S = \frac{(1-R)^2}{2R}$$

where:

K = light absorption coefficient;

S = light scattering coefficient; and

R = reflectance or reflection factor.

The K/S value is directly related to the color intensity of the fabric. Once reflectance, R, is determined, K/S can readily be calculated. The higher the K/S value, the greater the color depth and hence the greater the dye absorption in dyeing. For example, the K/S value of mercerized cotton control is greater than that of untreated cotton control, reflecting the greater dyeability of cotton fabrics after mercerization.

K/S values are also used to approximate the color strength of a sample relative to that of cellulosic control, which is simultaneously dyed in the same dye bath. Thus, the K/S of a sample divided by the K/S of untreated cellulose control (either mercerized or unmercerized) time 100 equals the percent dye absorbed relative to the untreated cotton control.

All the crosslinked samples had smooth-drying properties, both before and after dyeing. Of course, cotton finished with methylolamide crosslinking agent and glycol ether, but without any nitrogenous additive, had no affinity for acid and reactive dyes and little affinity for direct dyes. For example, the following K/S values were found: 0.8 with C.I. Acid Red 111, 1.3 with C.I. Reactive Blue 3, and 5.0 with C.I. Direct Red 80 (in contrast to K/S values reported in the Examples that follow).

EXAMPLES 1-5

C.I. Direct Red 80 (Molecular Weight=1240). A series of aqueous solutions were prepared containing 15% polyethylene glycol dimethylethers (PEGDME) having the molecular weights listed in Table I, along with 6% triethanolamine hydrochloride, 8% dimethylol dihydroxyethyleneurea (DMDHEU), 1.8% magnesium chloride hexahydrate, and 0.1% nononic wetting agent. Desized, scoured, and bleached mercerized cotton printcloth was padded with the formulation to 90% wet pickup. Each fabric was dried at 60° C. for 7 minutes, cured at 160° C. for 3 min, washed in water to remove unreacted material, and dried. Each sample of fabric was dyed with an aqueous solution containing 3% Direct Red 80 (based on the weight of the fabric) and 20% sodium chloride (also based on the weight of the fabric) at 95° C. for 60 minutes according to conventional procedures, except that the dye bath was adjusted to pH 3 with acetic acid. After the samples were washed and dried, color strength (K/S value, supra) was determined by means of a spectrophotometer. The K/S values in Table I show that all the PEGDME's tested were effective in improving the color strength of crosslinked cotton containing a hydroxyalkylamine and dyed with a high-molecular-weight direct dye.

TABLE I

| Example | Mol. wt. of PEGDME | K/S Value |
|---|---|---|
| 1 | 250 | 17.1 |
| 2 | 500 | 17.2 |
| 3 | 1000 | 17.4 |
| 4 | 2000 | 17.1 |
| 5 | Control[a] | 7.6 |

[a]Treated by same procedure, but without PEGDME.

EXAMPLES 6-10

C.I. Reactive Blue 3, a High-Molecular-Weight Reactive Dye. The procedures of Examples 1-5 were repeated except that C.I. Reactive Blue 3 was substituted for C.I. Direct Red 80. The results in Table II show the positive effect of PEGDME's on the color strength of cotton containing a hydroxyalkylamine when dyed with a high-molecular-weight reactive dye.

TABLE II

| Example | Mol. wt. of PEGDME | K/S Value |
|---|---|---|
| 6 | 250 | 28.4 |
| 7 | 500 | 29.6 |
| 8 | 1000 | 28.5 |
| 9 | 2000 | 28.4 |
| 10 | Control[a] | 15.0 |

[a]Without PEGDME.

EXAMPLES 11-15

C.I. Acid Red 111. The procedures of Examples 1-5 were repeated except that C.I. Acid Red 111 was substituted for C.I. Direct Red 80. The results in Table III show the positive effect of PEGDME's on the color strength of crosslinked cotton containing hydroxyalkylamine and dyed with an acid dye.

TABLE III

| Example | Mol. wt. of PEGDME | K/S Value |
|---|---|---|
| 11 | 250 | 23.4 |
| 12 | 500 | 21.8 |
| 13 | 1000 | 22.2 |
| 14 | 2000 | 20.9 |
| 15 | Control[a] | 8.9 |

[a]Without PEGDME.

EXAMPLES 16-20

Diethanolamine Hydrochloride. The procedures of Examples 1-5 were repeated except that diethanolamine hydrochloride was substituted for triethanolamine hydrochloride. The results in Table IV are similar to those in Table I.

TABLE IV

| Example | Mol. wt. of PEGDME | K/S Value |
|---|---|---|
| 16 | 250 | 19.0 |
| 17 | 500 | 19.7 |
| 18 | 1000 | 19.8 |
| 19 | 2000 | 19.1 |
| 20 | Control[a] | 11.0 |

[a]Without PEGDME.

EXAMPLES 21-25

N-Methyldiethanolamine Hydrochloride. The procedures of Examples 1-5 were repeated except that N-methyldiethanolamine hydrochloride was substituted for triethanolamine hydrochloride. The results in Table V are similar to those in Table I.

TABLE V

| Example | Mol. wt. of PEGDME | K/S Value |
|---|---|---|
| 21 | 250 | 17.8 |
| 22 | 500 | 18.2 |
| 23 | 1000 | 20.5 |
| 24 | 2000 | 20.5 |
| 25 | Control[a] | 14.8 |

[a]Without PEGDME.

EXAMPLES 26-29

Diglyme. The procedures of Examples 1-5 were repeated except that diglyme at the concentrations listed in Table VI was substituted for the 15% PEGDME, the concentration of triethanolamine hydrochloride was 5% instead of 6%, and the catalyst concentration was 3.2% instead of 1.8%. The results in Table VI show that the color strength of the crosslinked cotton was improved by finishing with a glycol ether in the presence of a hydroxyalkylamine, and that a diglyme greatly enhances color strength. All the fabrics had good smooth-dry properties.

TABLE VI

| Example | % Diglyme | K/S Value |
|---|---|---|
| 26 | 0 | 6.8 |
| 27 | 5 | 9.2 |
| 28 | 10 | 11.1 |
| 29 | 15 | 13.1 |

EXAMPLES 30–33

C.I. Reactive Blue 3. The procedures of Examples 26–29 were repeated except that C.I. Reactive Blue 3 was substituted for C.I. Direct Red 80. The results in Table VII, like those in Table VI, show the effectiveness of the glycol ether in improving the color strength of crosslinked cotton.

TABLE VII

| Example | % Diglyme | K/S Value |
|---|---|---|
| 30 | 0 | 12.2 |
| 31 | 5 | 12.9 |
| 32 | 10 | 16.5 |
| 33 | 15 | 19.8 |

Example 34

Tetraglyme. Cotton fabric was finished with 15% tetraglyme, 5% triethanolamine hydrochloride, 6% DMDHEU crosslinking agent, 2.4% magnesium chloride hexahydrate catalyst, and 0.1% nonionic wetting agent. A control sample was finished by the same procedure, but without tetraglyme. Both samples were dyed as described in Examples 1–5 except that C.I. Direct Red 79 was substituted for C.I. Direct Red 80. The K/S value was 11.2 with tetraglyme, compared to 7.8 for the control. These results show that the color strength of crosslinked cotton can be improved by finishing with the glycol ether, tetraglyme, in the presence of a hydroxyalkylamine.

EXAMPLE 35

PEGDME 500. Cotton fabric was finished with 20% PEGDME 500, 6% triethanolamine hydrochloride, 8% DMDHEU, 1.8% magnesium chloride hexahydrate/citric acid catalyst system (10:1 molar ratio), and 0.1% nononic wetting agent. A control sample was finished by the same procedure, but without PEGDME 500. Both samples were dyed with C.I. Direct Red 80 as described in Examples 1–5. The K/S value was 16.2 with PEGDME 500 compared to 7.3 for the control. These results show the effectiveness of the glycol ether in enhancing the dyeability of highly crosslinked fabric that had been finished in the presence of a tertiary hydroxyalkylamine.

EXAMPLE 36

C.I. Reactive Blue 3. The procedures of Example 35 were repeated except that C.I. Reactive Blue 3 was substituted for C.I. Direct Red 80. The K/S value was 22.0 with PEGDME 00 compared to 11.0 for the control. These results show the effectiveness of the glycol ether in increasing the affinity of highly crosslinked cotton for a high-molecular-weight reactive dye.

EXAMPLE 37

Bifunctional Quaternary Ammonium Compound. The procedures of Example 35 were repeated except that bis(2-hydroxyethyl)dimethylammonium chloride was substituted for triethanlamine hydrochloride. The K/S value was 23.3 with PEGDME 500 compared to 19.5 for the control. These results show that the glycol ether is effective in enhancing the dyeability of fabric finished with a bifunctional quaternary ammonium compound and a crosslinking agent.

EXAMPLE 38

Monofunctional Quaternary Ammonium Compound. The procedures of Example 37 were repeated except that (2-hydroxyethyl)trimethylammonium chloride was substituted for bis(2-hydroxyethyl)dimethylammonium chloride. The K/S value was 21.8 with PEGDME 500 compared to 17.9 for the control. These results show that the glycol ether is effective in enhancing the dyeability of fabric finished with a monofunctional quaternary ammonium compound and a crosslinking agent. It is understood that the foregoing detailed description is given merely by way of illustration and that modification and variations may be made therein without departing from the spirit and scope of the invention.

We claim:

1. A crosslinked cellulosic reaction product consisting essentially of: a cellulosic substrate; a methylolamide crosslinking agent bound to said cellulose substrate; one or more of a hydroxyalkylamine or a hydroxyalkyl quaternary ammonium compound chemically bound to said methylolamide crosslinking agent and one or more reactively inert glycol ether swelling agents incorporated into the cellulosic substrate; wherein said cellulosic reaction product is prepared by crosslinking a cellulosic material after it has been thoroughly wetted in a treating bath comprising:

about 3% to about 15% by weight of a methylolamide crosslinking agent, about 5% to about 40% by weight of one or more reactively inert glycol ether swelling agents, about 3% to about 15% by weight of one or more of a salt of a hydroxyalkylamine compound or a hydroxyalkyl quaternary ammonium salt, a catalyst present in an amount ranging from about 10% to about 60% by weight of said crosslinking agent which is capable of binding said methylolamide crosslinking agent to a cellulose substrate and binding said one or more of a hydroxyalkylamine from said salt of a hydroxyalkylamine compound, or a hydroxyalkyl quaternary ammonium compound from said hydroxyalkyl quaternary ammonium salt to said methylolamide crosslinking agent, and about 10% to about 90% by weight of an aqueous solvent.

2. The crosslinked cellulosic reaction product of claim 1 wherein said methylolamide crosslinking agent is selected from the group consisting of, methylolated ureas, cyclic ureas, urons, triazones, carbamates, triazines and alkylated and hydroxyalkylated derivatives thereof.

3. The crosslinked cellulosic reaction product of claim 2 wherein said methylolamide crosslinking agent is selected from the group consisting of dimethyloldihydroxyethyleneurea, dimethylolurea, partially methylolated urea, methylated urea-formaldehyde, dimethylolethyleneurea, dimethylol propyleneurea, trimethylol acetyleneurea, tetramethylol acetyleneurea, bis(methoxymethyl)uron, dimethylol methyl carbamate, dimethylol n-propyl carbamate, dimethylol isopropyl carbamate, trimethylolated melamine, tris(methoxymethyl)melamine, and hexa(methoxymethyl)melamine.

4. The crosslinked cellulosic reaction product of claim 1 wherein said reactively inert glycol ether is one or more compound of the general formula $CH_3—O—(CH_2—CH_2—O)_x—CH_3$ where x is from about 2 to about 68.

5. The crosslinked cellulosic reaction product of claim 4 wherein said reactively inert glycol ether is selected from the group consisting of diethylene qlycol dimethyl ether, triethylene glycol dimethyl ether and tetraethylene glycol dimethyl ether.

6. The crosslinked cellulosic reaction product of claim 1 wherein said hydroxyalkylamine is a primary, secondary, or tertiary hydroxyalkylamine; or mixtures thereof.

7. The crosslinked cellulosic reaction product of claim 6 wherein said hydroxyalkylamine is selected from the group consisting of monoethanolamine, diethanolamine, triethanolamine, 2-amino-2-ethyl-1,3-propanediol, 2-amino-2-methyl-1-propanol, 2-dimethylamino-2-methyl-1-propanol, N-methyldiethanolamine, and tris(hydroxymethyl) aminomethane, or mixtures thereof.

8. The crosslinked cellulosic reaction product of claim 6 wherein said hydroxyalkylamine is monoethanolamine, diethanolamine, triethanolamine or mixtures thereof.

9. The crosslinked cellulosic reaction product of claim 1 wherein said hydroxyalkyl quaternary ammonium compound is one of (2-hydroxyethyl)trimethylammonium chloride, bis(2-hydroxyethyl)dimethylammonium chloride or mixtures thereof.

10. The crosslinked cellulosic reaction product of claim 1 having an anionic dye bound thereto.

11. The crosslinked cellulosic reaction product of claim 10 wherein said anionic dye has a molecular weight of from about 750 to about 1500.

12. The crosslinked cellulosic reaction product of claim 10 wherein said anionic dye is an acid dye, a direct dye or a reactive dye.

13. The crosslinked cellulosic reaction product of claim 1 wherein the cellulose component of said cellulosic substrate is selected from the group consisting of cotton, rayon, jute, ramie and flax.

14. The crosslinked cellulosic reaction product of claim 1 wherein said cellulosic substrate is in a form selected from the group consisting of fibers, threads, linters, roving, fabrics, yarns, slivers and paper.

15. A process comprising contacting a cellulosic substrate with: A composition consisting essentially of about 3% to about 15% by weight of a methylolamide crosslinking agent, about 5% to about 40% by weight of one or more reactively inert glycol ether swelling agents, about 3% to about 15% by weight of one or more of a salt of a hydroxyalkylamine compound or a hydroxyalkyl quaternary ammonium salt, a catalyst present in an amount ranging from about 10% to about 60% by weight of said crosslinking agent which catalyzes both the binding of said methylolamide crosslinking agent to said substrate and the binding of said one or more of a hydroxyalkylamine from said salt of a hydroxyalkylamine compound or a hydroxyalkyl quaternary ammonium compound from said hydroxyalkyl quaternary ammonium salt to said methylolamide crosslinking agent, and about 10% to about 90% by weight of an aqueous solvent; under conditions whereby said reactively inert glycol ether swelling agents become incorporated into the cellulosic substrate, said methylolamide crosslinking agent binds to said substrate, and one or more of said hydroxyalkylamine from said salt of a hydroxyalkylamine compound or said hydroxyalkyl quaternary ammonium compound from said hydroxalkyl quaternary ammonium salt, bind to said methylolamide to produce a crosslinked cellulose.

16. The process of claim 15 wherein said methylolamide crosslinking agent is selected from the group consisting of methylolated ureas, cyclic ureas, urons, triazones, carbamates, triazines and alkylated and hydroxyalkylated derivatives thereof.

17. The process of claim 16 wherein said methylolamide crosslinking agent is selected from the group consisting of dimethyloldihydroxyethyleneurea, dimethylolurea, partially methylolated urea, methylated urea-formaldehyde, dimethylolethyleneurea, dimethylol propyleneurea, trimethylol acetyleneurea, tetramethylol acetyleneurea, bis(methoxymethyl)uron, dimethylol methyl carbamate, dimethylol n-propyl carbamate, dimethylol isopropyl carbamate, trimethylolated melamine, tris(methoxymethyl)melamine, and hexa(methoxymethyl) melamine.

18. The process of claim 15 wherein said reactively inert glycol ether is one or more compound of the general formula $CH_3—O—(CH_2—CH_2—O)_x—CH_3$ where x is from about 2 to about 68.

19. The process of claim 18 wherein said reactively inert glycol ether is selected from the group consisting of diethylene glycol dimethyl ether, triethylene glycol dimethyl ether and tetraethylene glycol dimethyl ether.

20. The process of claim 15 wherein said salt of a hydroxyalkylamine compound is a halo salt and said hydroxyalkyl quaternary ammonium salt is a halo or sulfate salt.

21. The process of claim 15 wherein said hydroxyalkylamine is a primary, secondary or tertiary hydroxyalkylamine; or mixtures thereof.

22. The process of claim 21 wherein said hydroxyalkylamine is selected from the group consisting of monoethanolamine, diethanolamine, triethanolamine, 2-amino-2-ethyl-1,3-propandiol, 2-amino-2-methyl-1-propanol, 2-dimethylamino-2-methyl-1-propanol, N-methyldiethanolamine, and tris(hydroxymethyl) aminomethane, or mixtures thereof.

23. The process of claim 15 wherein said hydroxyalkyl quaternary ammonium salt is (2-hydroxyethyl)trimethylammonium chloride, bis(2-hydroxyethyl)dimethylammonium chloride, tris(2-hydroxyethyl)methylammonium chloride, tetrakis(2-hydroxyethyl)ammonium chloride or mixtures thereof.

24. The process of claim 15 wherein said catalyst is a halide or nitrate salt of zinc or magnesium either alone or in combination with citric acid.

25. The process of claim 24 wherein said catalyst is magnesium chloride either alone or in combination with citric acid.

26. The process of claim 15 wherein the cellulose component of said cellulosic substrate is selected from the group consisting of cotton, rayon, jute, ramie and flax.

27. The process of claim 15 wherein said cellulosic substrate is in a form selected from the group consisting of fibers, threads, linters, roving, fabrics, yarns, slivers and paper.

28. The process of claim 15 further including the steps of drying and curing said crosslinked cellulose.

29. The process of claim 28 further including a step of dyeing the dried and cured crosslinked cellulose with an anionic dye.

30. The process of claim 29 wherein said anionic dye has a molecular weight of from about 750 to about 1500.

31. A composition consisting essentially of: about 3% to about 15% by weight of a methylolamide crosslinking agent, about 5% to about 40% by weight of one or more reactively inert glycol ether swelling agents, about 3% to about 15% by weight of one or more of a salt of a hydroxyalkylamine compound or a hydroxyalkyl quaternary ammonium salt, a catalyst present in an amount ranging from about 10% to about 60% by weight of said crosslinking agent which is capable of binding said methylolamide crosslinking agent to a cellulose substrate and binding said one or more of a hydroxyalkylamine from said salt of a hydroxyalkylamine compound, or a hydroxyalkyl quaternary ammonium compound from said hydroxyalkyl quaternary ammonium salt to said methylolamide crosslinking agent, and about 10% to about 90% by weight of an aqueous solvent.

32. The composition of claim 31 wherein said methylolamide crosslinking agent is selected from the group consisting of methylolated ureas, cyclic ureas, urons, triazones, carbamates, triazines and alkylated and hydroxyalkylated derivatives thereof.

33. The composition of claim 32 wherein said methylolamide crosslinking agent is selected from the group consisting of dimethyloldihydroxyethyleneurea, dimethylolurea, partially methylolated urea, methylated urea-formaldehyde, dimethylolethyleneurea, dimethylol propyleneurea, trimethylol acetyleneurea, tetramethylol acetyleneurea, bis(methoxymethyl)uron, dimethylol methyl carbamate, dimethylol n-propyl carbamate, dimethylol isopropyl carbamate, trimethylolated melamine, tri(methoxymethyl)melamine, and hexa(methoxymethyl) melamine.

34. The composition of claim 31 wherein said reactively inert glycol ether is one or more compounds of the general formula $CH_3—O—(CH_2—CH_2—O)_x—CH_3$ where x is from about 2 to about 68.

35. The composition of claim 34 wherein said reactively inert glycol ether is selected from the group consisting of diethylene glycol dimethyl ether , triethylene glycol dimethyl ether and tetraethylene glycol dimethyl ether.

36. The composition of claim 31 wherein said salt of a hydroxyalkylamine compound is a halo salt and said hydroxyalkyl quaternary ammonium salt is a halo or sulfate salt.

37. The composition of claim 31 wherein said hydroxyalkylamine is a primary, secondary or tertiary hydroxyalkylamine; or mixtures thereof.

38. The composition of claim 37 wherein said hydroxyalkylamine is selected from the group consisting of monoethanolamine, diethanolamine, triethanolamine, 2-amino-2-ethyl-1,3-propanediol, 2-amino-2-methyl-1-propanol, 2-dimethylamino-2-methyl-1-propanol, N-methyldiethanolamine, and tris(hydroxymethyl)aminomethane, or mixtures thereof.

39. The composition of claim 31 wherein said hydroxyalkyl quaternary ammonium salt is bis(2-hydroxyethyl)dimethylammonium chloride, (2-hydroxyethyl)-trimethylammonium chloride, or mixtures thereof.

40. The composition of claim 31 wherein said catalyst is a halide or nitrate salt of zinc or magnesium either alone or in combination with citric acid.

41. The composition of claim 40 wherein said catalyst is magnesium chloride either alone or in combination with citric acid.

* * * * *